US010900239B1

(12) United States Patent
Bilge

(10) Patent No.: US 10,900,239 B1
(45) Date of Patent: Jan. 26, 2021

(54) SYSTEM FOR MOUNTING WALL PANELS TO AN EXISTING WALL

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 0 days.

(21) Appl. No.: 16/580,869

(22) Filed: Sep. 24, 2019

(51) Int. Cl.
*E04F 13/08* (2006.01)

(52) U.S. Cl.
CPC ..... *E04F 13/0846* (2013.01)

(58) Field of Classification Search
CPC ... E04F 13/08; E04F 13/0801; E04F 13/0803; E04F 13/0805; E04F 13/0807; E04F 13/0808; E04F 13/081; E04F 13/0814; E04F 13/0816; E04F 13/0819; E04F 13/083; E04F 13/0841; E04F 13/0846; E04F 13/0851; E04F 13/24; E04F 13/25
USPC ..... 52/235, 506.01, 506.05, 506.06
See application file for complete search history.

(56) References Cited

U.S. PATENT DOCUMENTS 4,228,982 A 10/1980 Sellera
4,483,122 A * 11/1984 Crandell ..... E04F 13/0889 52/235
5,301,484 A * 4/1994 Jansson ..... E04F 13/145 52/122.1
6,053,468 A 4/2000 Francis
6,226,947 B1 * 5/2001 Bado ..... E04F 19/06 52/483.1
6,427,410 B1 * 8/2002 Lind ..... E04F 13/0808 52/508
7,748,181 B1 * 7/2010 Guinn ..... E04F 13/0878 52/235
8,127,507 B1 * 3/2012 Bilge ..... E04F 13/0823 52/235
8,468,765 B1 * 6/2013 Kim ..... E04F 13/0835 52/235
8,966,849 B1 3/2015 Bilge
8,979,052 B2 * 3/2015 Uota ..... E04F 13/0846 248/231.81
9,359,770 B1 6/2016 Bilge
9,506,252 B2 * 11/2016 Molteni ..... A47F 5/0846
9,562,361 B2 2/2017 Bilge
9,631,372 B1 4/2017 Bilge
9,765,528 B2 9/2017 Bilge
10,011,997 B1 * 7/2018 Bilge ..... E04F 13/0733
10,253,505 B2 4/2019 Bilge
10,260,240 B1 4/2019 Bilge
(Continued)

*Primary Examiner* — Kyle J. Walraed-Sullivan
(74) *Attorney, Agent, or Firm* — Joshua Kaplan, Esq; Kaplan Law Practice LLC

(57) ABSTRACT

A system for mounting wall panels to an existing wall, includes a plurality of elongated mounting tracks, each mounting track including a base wall adapted to be secured to the existing wall, an upwardly opening L-shaped hanger supporting wall extending forwardly from the base wall, and an upwardly opening L-shaped hanger stabilizing wall extending forwardly from the base wall in spaced relation from the hanger mounting wall. A plurality of mounting hangers are provided, each mounting hanger including a wall panel securing wall adapted to be secured to a wall panel, a downwardly opening L-shaped hanger mounting wall extending rearwardly from the wall panel securing wall and adapted to be hung on the hanger supporting wall, and a hanger retaining wall extending from the wall panel securing wall and adapted to engage with the hanger stabilizing wall.

9 Claims, 14 Drawing Sheets

(56) References Cited

U.S. PATENT DOCUMENTS

| | | | | |
|---|---|---|---|---|
| 2002/0124514 | A1* | 9/2002 | Higgins | E04F 13/081 52/506.06 |
| 2003/0038222 | A1 | 2/2003 | Holmes | |
| 2008/0066407 | A1* | 3/2008 | Son | E04F 13/0819 52/364 |
| 2008/0134594 | A1* | 6/2008 | Ness | E04F 13/0889 52/200 |
| 2009/0241451 | A1* | 10/2009 | Griffiths | E04F 13/12 52/309.4 |
| 2009/0272055 | A1* | 11/2009 | Griffiths | E04F 13/081 52/309.3 |
| 2010/0263314 | A1* | 10/2010 | MacDonald | E04F 13/0826 52/506.05 |
| 2012/0017530 | A1* | 1/2012 | Hummel, III | E04F 13/081 52/506.05 |
| 2012/0304572 | A1* | 12/2012 | Aboukhalil | E04F 13/0733 52/489.1 |
| 2013/0205698 | A1* | 8/2013 | Todd | E04F 13/083 52/302.1 |
| 2013/0269276 | A1* | 10/2013 | Gaynor | E04F 13/083 52/506.05 |
| 2014/0150614 | A1* | 6/2014 | Aboukhalil | E04F 13/007 83/39 |
| 2014/0290166 | A1* | 10/2014 | Bordener | E04F 13/083 52/474 |
| 2016/0102462 | A1* | 4/2016 | Griffiths | E04F 13/0889 52/550 |
| 2016/0319552 | A1* | 11/2016 | Aboukhalil | E04F 13/0817 |

* cited by examiner

SYSTEM FOR MOUNTING WALL PANELS TO AN EXISTING WALL

BACKGROUND OF THE INVENTION

The present invention relates generally to a wall system, and more particularly, to a system for easily mounting wall panels over an existing wall.

In order to enhance the look of a wall structure, it is known to secure decorative wall panels to the wall structure. However, the securement of wall panels to the wall structure is generally a long and tedious job since it entails the use of additional fastening devices to secure each wall panel to the wall structure. Examples of such arrangements are shown in applicant's earlier U.S. Pat. Nos. 8,966,849; 9,359,770; 9,562,361; 9,631,372; 9,765,528; 10,011,997; 10,253,505; and 10,260,240.

It would therefore be desirable to provide wall panels that can more easily be secured to an existing wall.

SUMMARY OF THE INVENTION

Accordingly, it is an object of the present invention to provide a system for mounting wall panels to an existing wall that overcomes the aforementioned problems.

It is another object of the present invention to provide a system for mounting wall panels to an existing wall in which the wall panels can merely be hung on mounting tracks by mounting hanger secured to the wall panels.

It is still another object of the present invention to provide a system for mounting wall panels to an existing wall in which each mounting hanger is mounted to a mounting track at two different positions to provide increased securement and stabilization of the mounting hanger on the mounting track.

It is yet another object of the present invention to provide a system for mounting wall panels to an existing wall in which each mounting hanger includes an arrangement for vertically adjusting the mounting hanger on a respective mounting track.

It is a further object of the present invention to provide a system for mounting wall panels to an existing wall in which each mounting track is adapted to be secured to the existing wall with at least one degree of freedom.

In accordance with an aspect of the present invention, a system for mounting wall panels to an existing wall, includes a plurality of elongated mounting tracks, each mounting track including a base wall adapted to be secured to the existing wall, a hanger supporting wall extending forwardly from the base wall, and a hanger stabilizing wall extending forwardly from the base wall in spaced relation from the hanger mounting wall. A plurality of mounting hangers are provided, each mounting hanger including a wall panel securing wall adapted to be secured to a wall panel, a hanger mounting wall extending rearwardly from the wall panel securing wall and adapted to be hung on the hanger supporting wall, and a hanger retaining wall extending from the wall panel securing wall and adapted to engage with the hanger stabilizing wall.

The hanger supporting wall includes an upwardly opening L-shaped wall extending forwardly from the base wall, and the hanger mounting wall includes a downwardly opening L-shaped wall extending rearwardly from the wall panel securing wall, for engaging with the hanger supporting wall. In like manner, the hanger stabilizing wall includes an upwardly opening L-shaped wall extending forwardly from the base wall, and the hanger retaining wall extends rearwardly and downwardly from the wall panel securing wall, for engaging with the hanger stabilizing wall. Preferably, the hanger stabilizing wall extends forwardly from the base wall to a greater extent than the hanger supporting wall.

The hanger mounting wall includes a threaded adjustment opening for receiving a set screw for engagement with the hanger supporting wall to adjust the height of each mounting hanger relative to each respective elongated mounting track. The hanger mounting wall includes a threaded fixing opening for receiving a screw to fix the hanger mounting wall to the hanger supporting wall. In this regard, the screw in the threaded fixing opening fixes the hanger mounting wall to the hanger supporting wall with a wedging action.

The wall panel securing wall includes an arrangement for securing each the mounting hanger to a respective the wall panel. In one embodiment, the arrangement includes openings in the wall panel securing wall for receiving screws therethrough.

In another embodiment, the arrangement includes two angled slot openings in a rear surface of each the wall panel, each slot opening extending at an angle different from the angle of the other slot opening, and two wall panel securing plates extending forwardly from the wall panel securing wall at different angles from each other for insertion in the two angled slot openings from a side edge of each the wall panel.

In a modification, each mounting hanger includes a first mounting hanger part which includes a first part of the wall panel securing wall, the hanger mounting wall and part of the arrangement, and a second mounting hanger part which includes a second part of the wall panel securing wall, the hanger retaining wall and part of the arrangement, wherein the first mounting hanger part and the second mounting hanger part are adapted to be assembled separately and independently with a respective the wall panel, and thereafter secured together. In such case, preferably, the first mounting hanger part includes one of the wall panel securing plates and the second mounting hanger part includes the other one of the wall panel securing plates.

In the modification, each of the first and second parts of the wall panel securing wall includes an opening aligned with the other of the first and second parts of the wall panel securing wall when the first and second mounting hanger parts are assembled with the wall panel, for receiving a screw therethrough and into the wall panel so as to secure the first and second mounting hanger parts together and to the wall panel.

In a further modification, the base wall includes an adjustment support member extending rearwardly therefrom for engagement with a support assembly secured to the existing wall, for movement relative thereto with at least one degree of freedom.

The above and other features of the invention will become readily apparent from the following detailed description thereof which is to be read in connection with the accompanying drawings.

DETAILED DESCRIPTION

Figure 1:
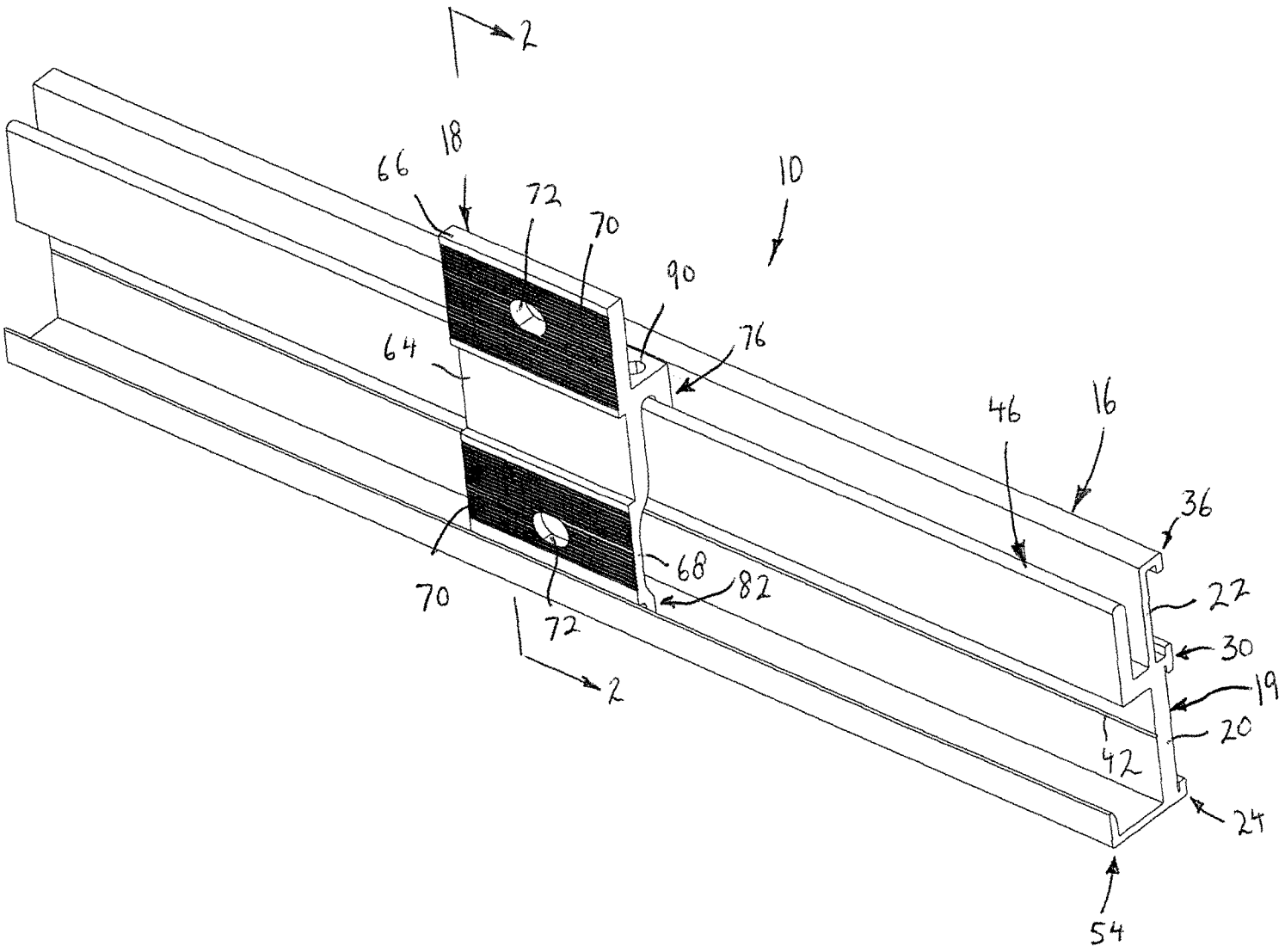
FIG. 1 is a front perspective view of a system for mounting wall panels to an existing wall according to a first embodiment of the present invention.
Figure 2:
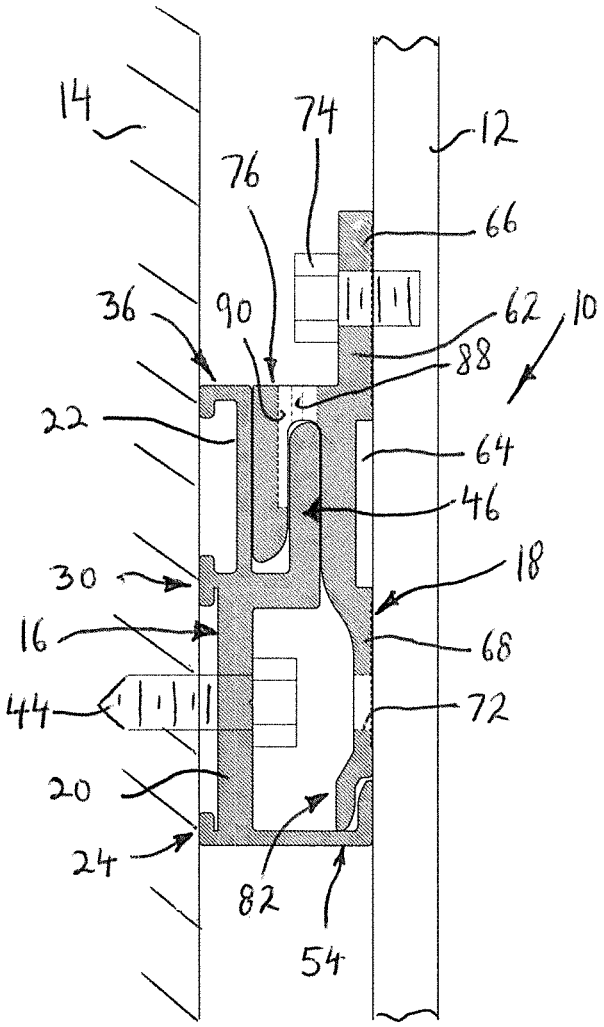
FIG. 2 is a cross-sectional view of the system of FIG. 1, taken along line 2-2 of FIG. 1.
Figure 3:
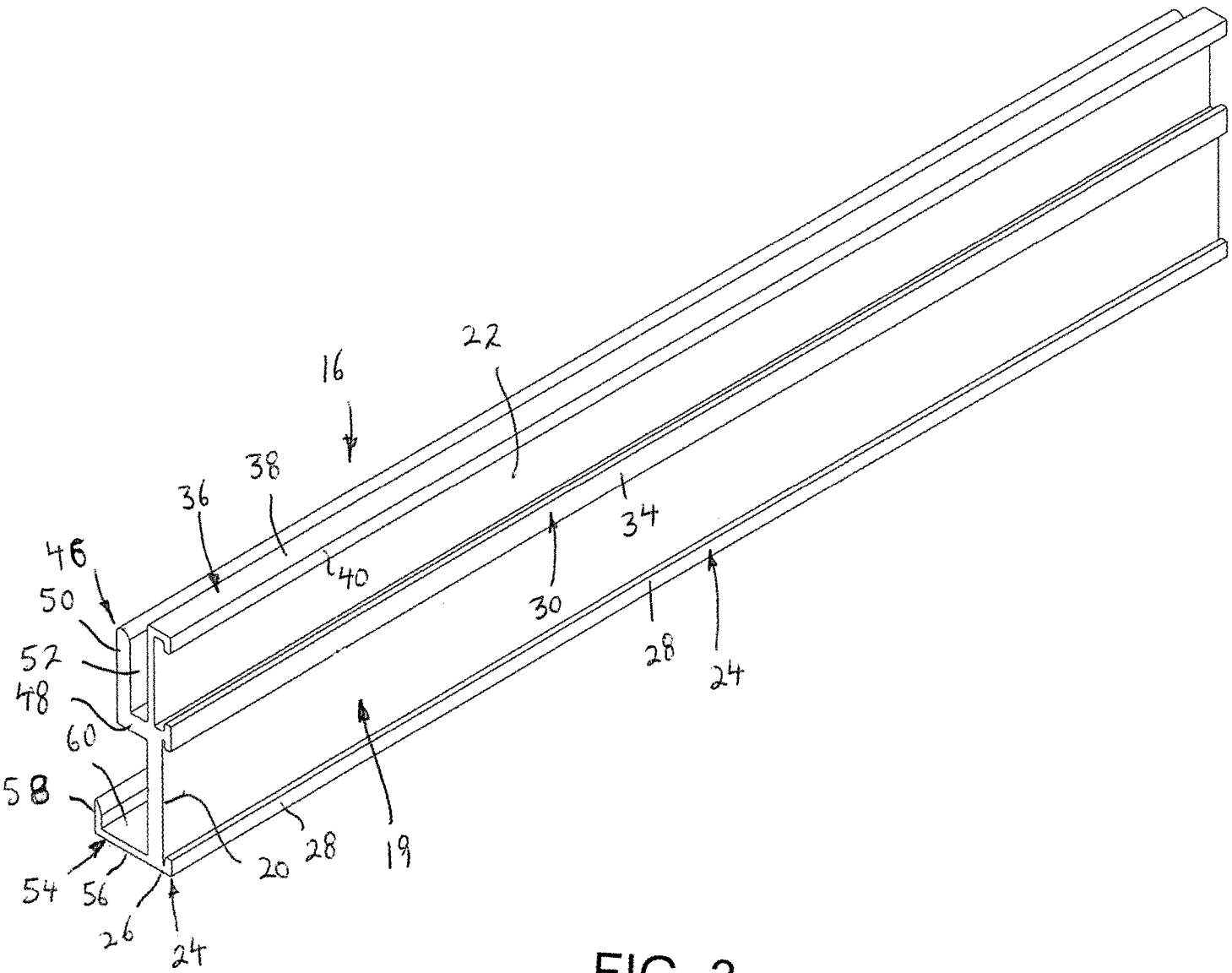
FIG. 3 is a rear perspective view of the elongated mounting track of the system of FIG. 1.
Figure 4:
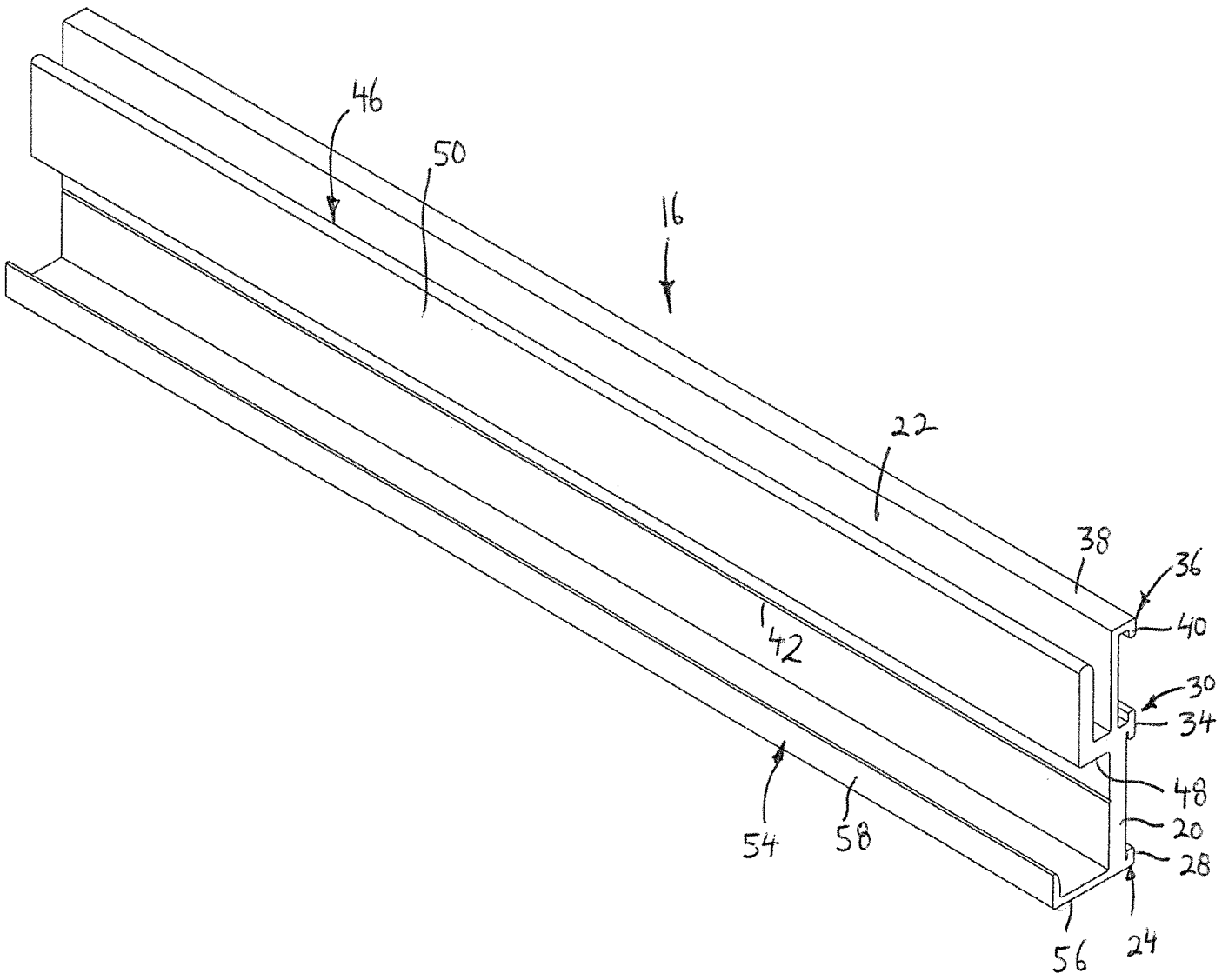
FIG. 4 is a front perspective view of the elongated mounting track.
Figure 5:
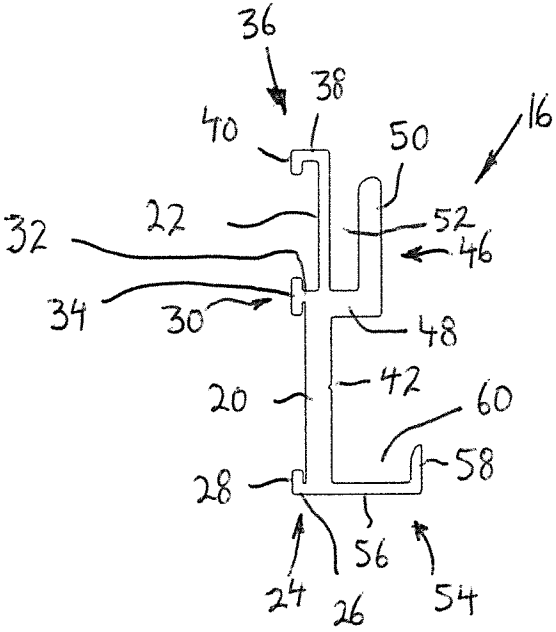
FIG. 5 is a side elevational view of the elongated mounting track.
Figure 6:
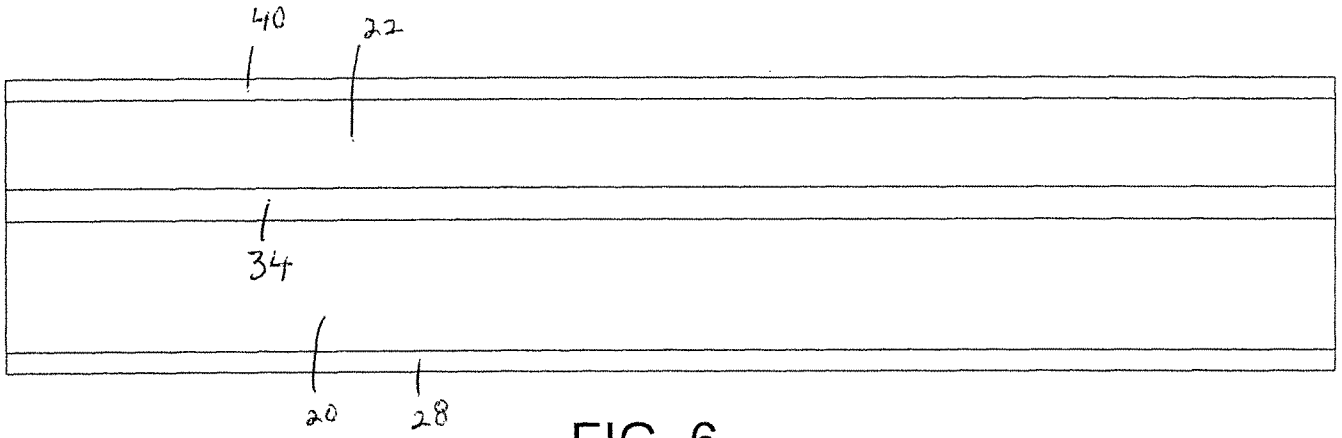
FIG. 6 is a rear elevational view of the elongated mounting track.
Figure 7:
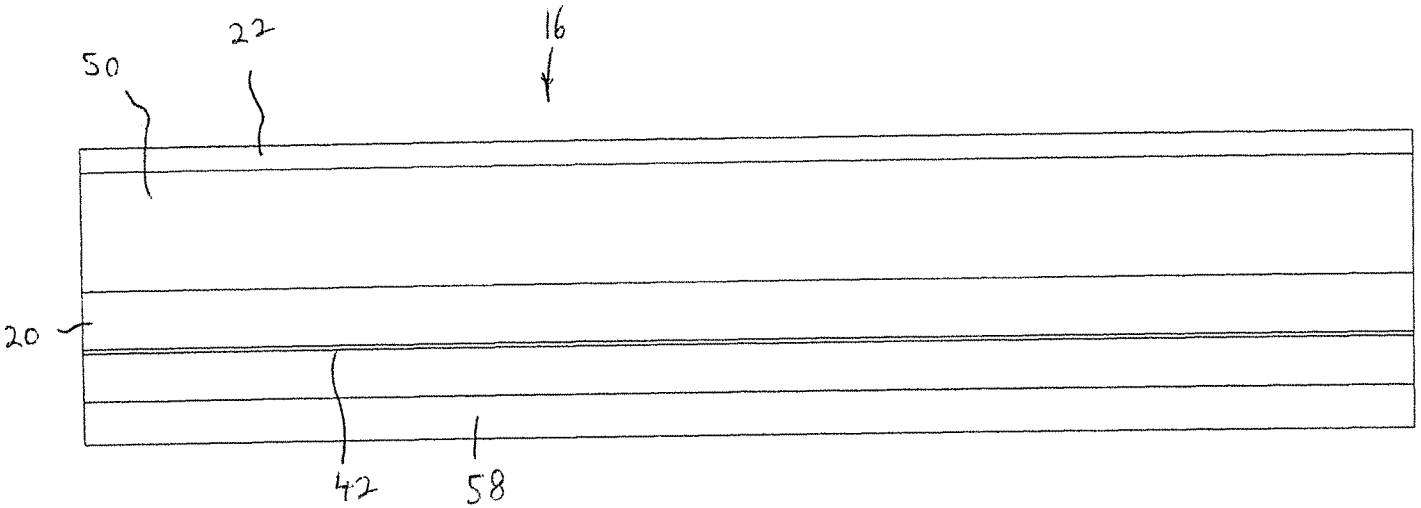
FIG. 7 is a front elevational view of the elongated mounting track.
Figure 8:
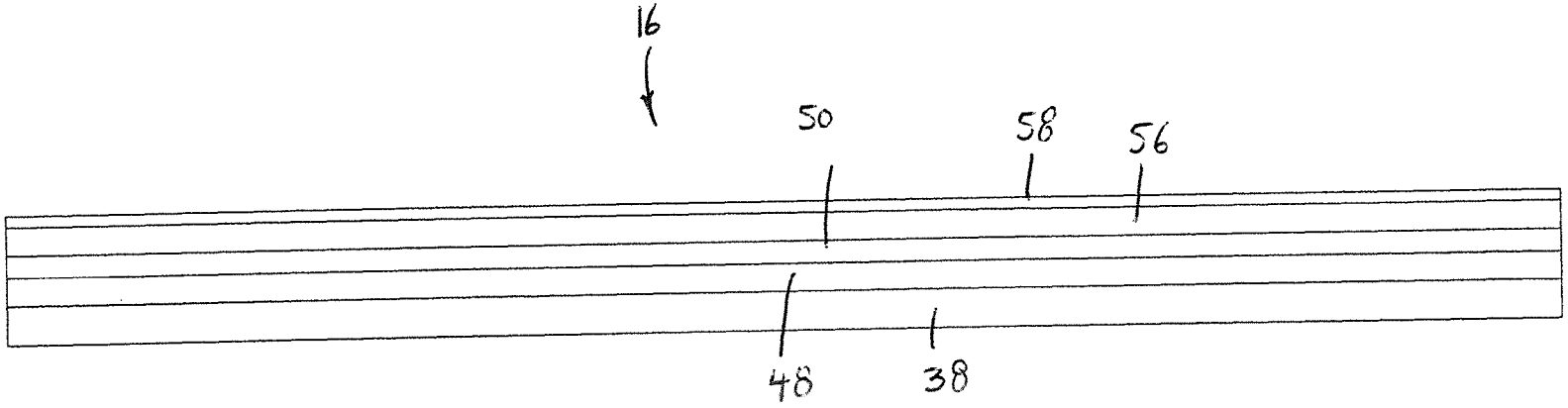
FIG. 8 is a top plan view of the elongated mounting track.
Figure 9:
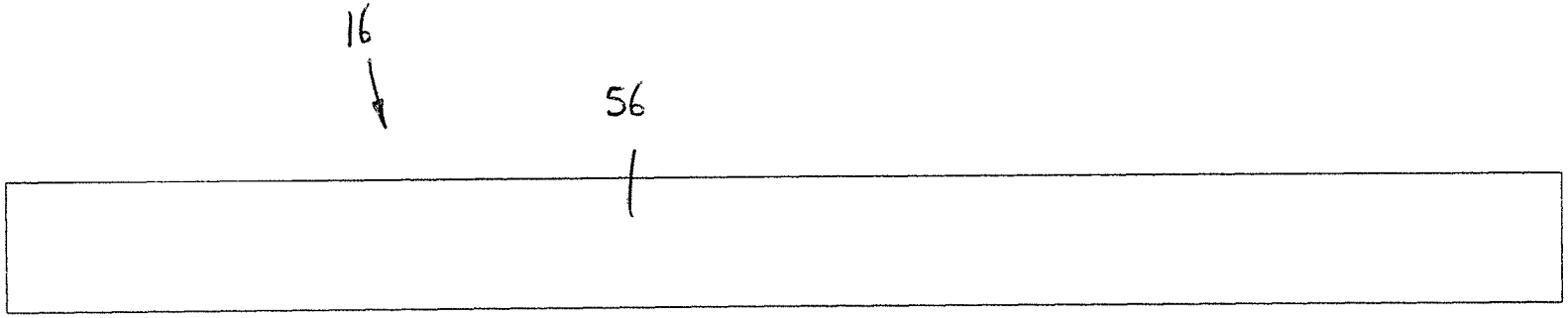
FIG. 9 is a bottom plan view of the elongated mounting track.
Figure 10:
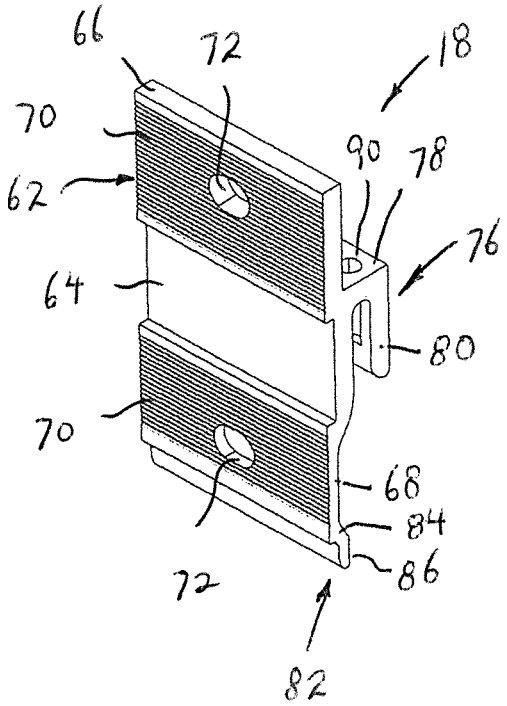
FIG. 10 is a front perspective view of the mounting hanger of the system of FIG. 1.
Figure 11:
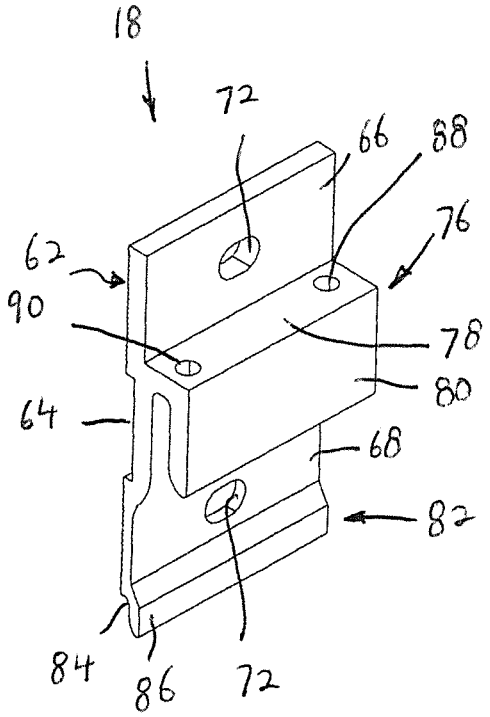
FIG. 11 is a rear perspective view of the mounting hanger.
Figure 14:
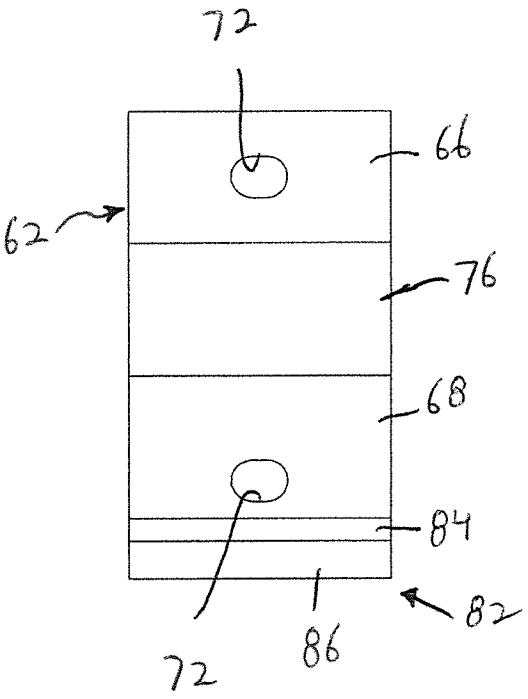
FIG. 14 is a rear plan view of the mounting hanger.
Figure 13:
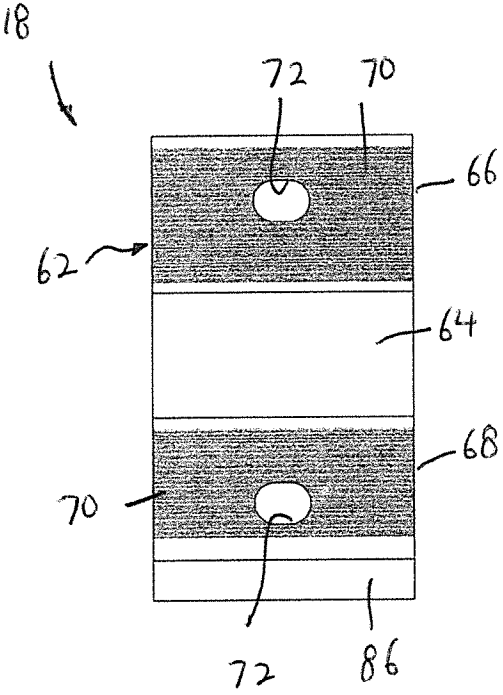
FIG. 13 is a front plan view of the mounting hanger.
Figure 12:
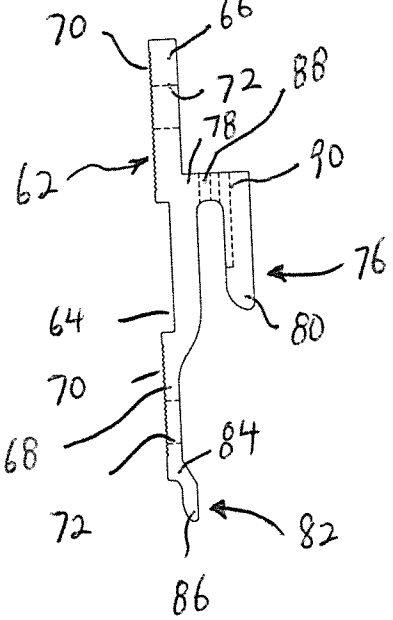
FIG. 12 is a side elevational view of the mounting hanger.
Figure 15:
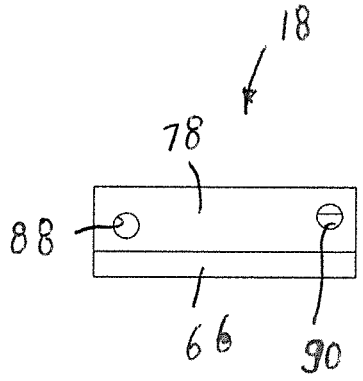
FIG. 15 is a top plan view of the mounting hanger.
Figure 16:
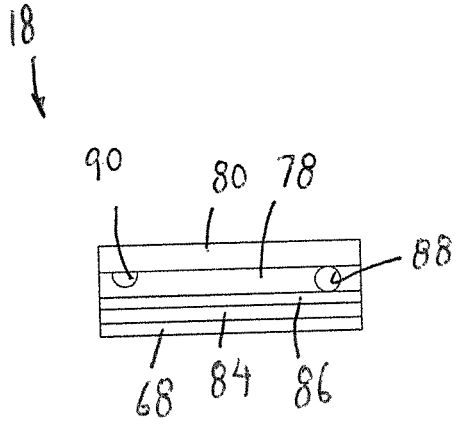
FIG. 16 is a bottom plan view of the mounting hanger.
Figure 17:
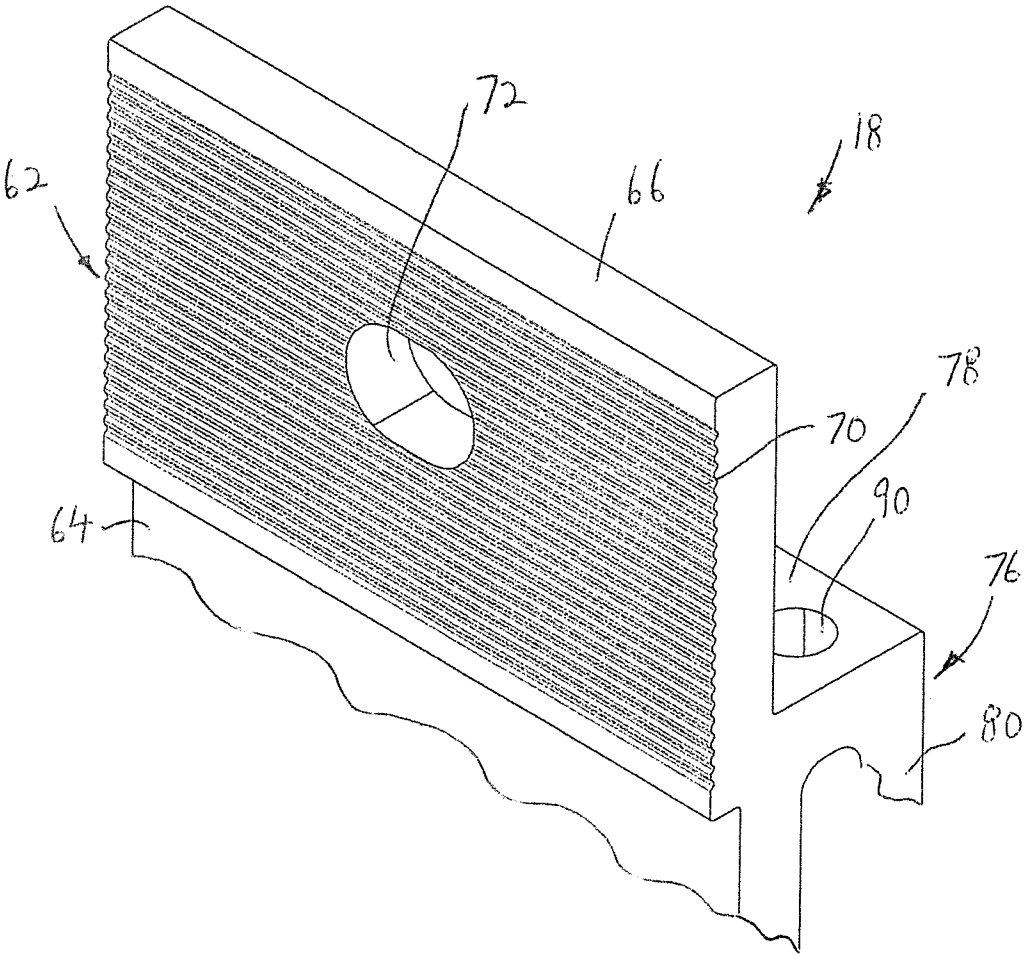
FIG. 17 is an enlarged perspective view of the top portion of the mounting hanger.

Referring to the drawings in detail, and initially to FIGS. 1-17, there is shown a wall panel mounting system 10 for easily mounting wall panels 12 over and to an existing wall 14 according to a first embodiment of the present invention.

Wall panel mounting system 10 includes an elongated mounting track 16 which is secured to existing wall 14 and a plurality of mounting hangers 18 secured to a rear surface of each wall panel 12, with each mounting hanger 18 adjustably mounted on mounting track 16 and secured thereto.

Specifically, elongated mounting track 16 includes a base wall 19 adapted to be secured to existing wall 14. Base wall 19 includes a first horizontally extending wall 20 of a first thickness and a second horizontally extending wall 22 of a second lesser thickness and extending upwardly from the upper end of first extending wall 20.

A first spacer wall 24 in an L-shape extends rearwardly from the lower end of first horizontally extending wall 20, and includes a first wall 26 extending rearwardly and perpendicular to first horizontally extending wall 20 and a second wall 28 extending upwardly from the free end of first wall 26 in parallel, spaced relation to first horizontally extending wall 20. A second spacer wall 30 in a T-shape extends rearwardly from the upper end of first horizontally extending wall 20, and includes a first wall 32 extending perpendicular to first horizontally extending wall 20 and a second wall 34 extending in a vertical direction from the free end of first wall 32 so as to be bisected by first wall 32, and is coplanar and parallel to second wall 28 and in parallel, spaced relation to first horizontally extending wall 20. A third spacer wall 36 in an L-shape extends rearwardly from the upper end of second horizontally extending wall 22, and includes a first wall 38 extending perpendicular to second horizontally extending wall 22 and a second wall 40 extending downwardly from the free end of first wall 38 in parallel, spaced relation to first horizontally extending wall 20 and coplanar and parallel to second walls 28 and 34.

With this arrangement, the rear faces of second walls 28, 34 and 40 are coplanar so as to be flush against existing wall 14 when assembled therewith. In this regard, the front surface of first horizontally extending wall 20 has a shallow V-shaped notch 42 extending horizontally therealong at an approximate mid-height thereof. This makes it easy to secure screws 44 (FIG. 2) through first horizontally extending wall 20 into existing wall 14 to secure elongated mounting track 16 to existing wall 14. In such condition, it will be appreciated that first horizontally extending wall 20 and second horizontally extending wall 22 are in parallel spaced relation to existing wall 14. This permits air to circulate therethrough for cooling and drying purposes.

It will be appreciated that spacer walls 24, 30 and 36 can be eliminated and are not required by the present invention.

A hanger supporting wall 46 having an L-shape, extends forwardly from the front surface at the upper end of first horizontally extending wall 20. Specifically, hanger supporting wall 46 includes a first wall 48 extending perpendicular to first horizontally extending wall 20 and a second wall 50 extending upwardly from the free end of first wall 48 in parallel, spaced relation to second horizontally extending wall 22. As a result, a horizontally elongated channel 52 is defined by and between second horizontally extending wall 22, first wall 48 and second wall 50.

Finally, elongated mounting track 16 includes a hanger stabilizing wall 54 extending forwardly from the front surface at the lower end of first horizontally extending wall 20. Specifically, hanger stabilizing wall 54 includes a first wall 56 extending perpendicular to first horizontally extending wall 20 and a second wall 58 extending upwardly from the free end of first wall 56 in parallel, spaced relation to first horizontally extending wall 20. As a result, a horizontally elongated channel 60 is defined by and between first horizontally extending wall 20, first wall 56 and second wall 58. It will be appreciated that first wall 56 extends out from first horizontally extending wall 20 a greater distance than first wall 48, the reason for which will be explained hereafter.

Each mounting hanger 18 includes a vertically extending main wall panel securing wall 62 having a front surface to which a wall panel 12 is secured. A central rectangular recess 64 is formed in the front surface of main wall securing wall 62 so as to divide main wall panel securing wall 62 into an upper section 66 and a lower section 68. Serrations or teeth 70 are formed on the front facing surfaces of upper section 66 and lower section 68 for better engagement with the rear surface of wall panel 12. In addition, openings 72 are provided through upper section 66 and lower section 68 through which screws 74 (FIG. 2) are inserted for securing mounting hanger 18 to the rear surface of wall panel 12.

Each mounting hanger 18 includes an L-shaped hanger mounting wall 76 for hanging, and thereby securing, the mounting hanger 18 to an elongated mounting track 16. Specifically, each hanger mounting wall 76 includes a first wall 78 extending rearwardly at a right angle from the rear surface at the lower end of upper section 66 and a second wall 80 extending downwardly from the free end of first wall 78 in parallel, spaced relation to main wall panel securing wall 62 at recess 64. In this manner, second wall 80 extends into channel 52 of elongated mounting track 16 while the lower surface of first wall 78 rests on the upper free end of second wall 50 of elongated mounting track 16.

In accordance with an important aspect of the present invention, a lower retaining wall 82 extends rearwardly and downwardly from the lower end of lower section 68. Specifically, lower retaining wall 82 includes a first wall 84 angled rearwardly and downwardly about 45° from the lower end of lower section 68 and a second wall 86 extending vertically down from the lower end of first angled wall 84 in parallel but offset relation to lower section 68. The lower end of lower section 68 is positioned directly above the upper edge of second wall 58, while second wall 86 sits behind second wall 58 and rests on first wall 56, to provide a second level of securement of mounting hanger 18 to elongated mounting track 16.

This arrangement also provides for easier sliding and adjustment of each mounting hanger 18 along the respective elongated mounting track 16, while also providing a two position retention and stabilization of mounting hanger 18 on elongated mounting track 16.

The present invention also provides for vertical adjustment and fixed securement of each mounting hanger 18 on a respective elongated mounting track 16.

Specifically, two offset openings 88 and 90 are provided in L-shaped hanger mounting wall 76. First adjustment opening 88 is internally threaded and is positioned immediately over the upper free end of second wall 50, for receiving a set screw (not shown), the lower end of which engages the upper edge of second wall 50 for lowering or raising mounting hanger 18 relative to elongated mounting track 16. Second fixing opening 90 is also internally threaded but is positioned offset from first opening 88 so as to extend into channel 50, while also wedging against the rear surface of second wall 52 to fixedly secure mounting hanger 18 thereto. In this regard, second fixing opening 90 partially extends into the rear surface of second wall 50, as shown by the dashed lines in FIG. 12.

With this arrangement, elongated mounting tracks 16 are secured to existing wall 14 at desired locations. Mounting hangers 18 are secured by screws 74 or other fastening devices through openings 72 to the rear surface of wall panels 12. Thereafter, wall panels 12 are mounted to existing wall 14 by inserting second wall 80 into channel 52 behind second wall 50 of hanger supporting wall 46, with the lower surface of first wall 78 resting on the upper edge of second wall 50. At the same time, second wall 86 of lower retaining wall 82 is positioned behind second wall 58 of hanger stabilizing wall 54 to provide stabilization of mounting hangers 18 on elongated mounting track 16.

Thereafter, a set screw (not shown) is screwed into or out of first adjustment opening 88 to adjust the vertical position of mounting hanger 18 on the elongated mounting track 16. This permits for leveling of wall panels 12 on existing wall 14. After this adjustment operation, a securing screw (not shown) is threaded through second fixing opening 90 to engage the rear surface of second wall 50 and thereby secure mounting hanger 18 at the adjusted position to the respective elongated mounting track 16. The wall panels 12 are thereby fixed to existing wall 14.

It will be appreciated that various modifications can be made to the above invention within the scope of the claims. For example, it is possible that hanger stabilizing wall 54 functions as the hanger mounting wall, so that all the weight of mounting hangers 18 and wall panels 12 rest on hanger stabilizing wall 54, and in such case, hanger supporting wall 46 functions as the hanger stabilizing wall, that is, the reverse of what is described above. As a further alternative, both hanger supporting wall 46 and hanger stabilizing wall 54 can function as both a hanger mounting wall which supports the weight of the mounting hangers 18 and wall panels 12, while also both functioning as a hanger stabilizing wall.

Figure 18:
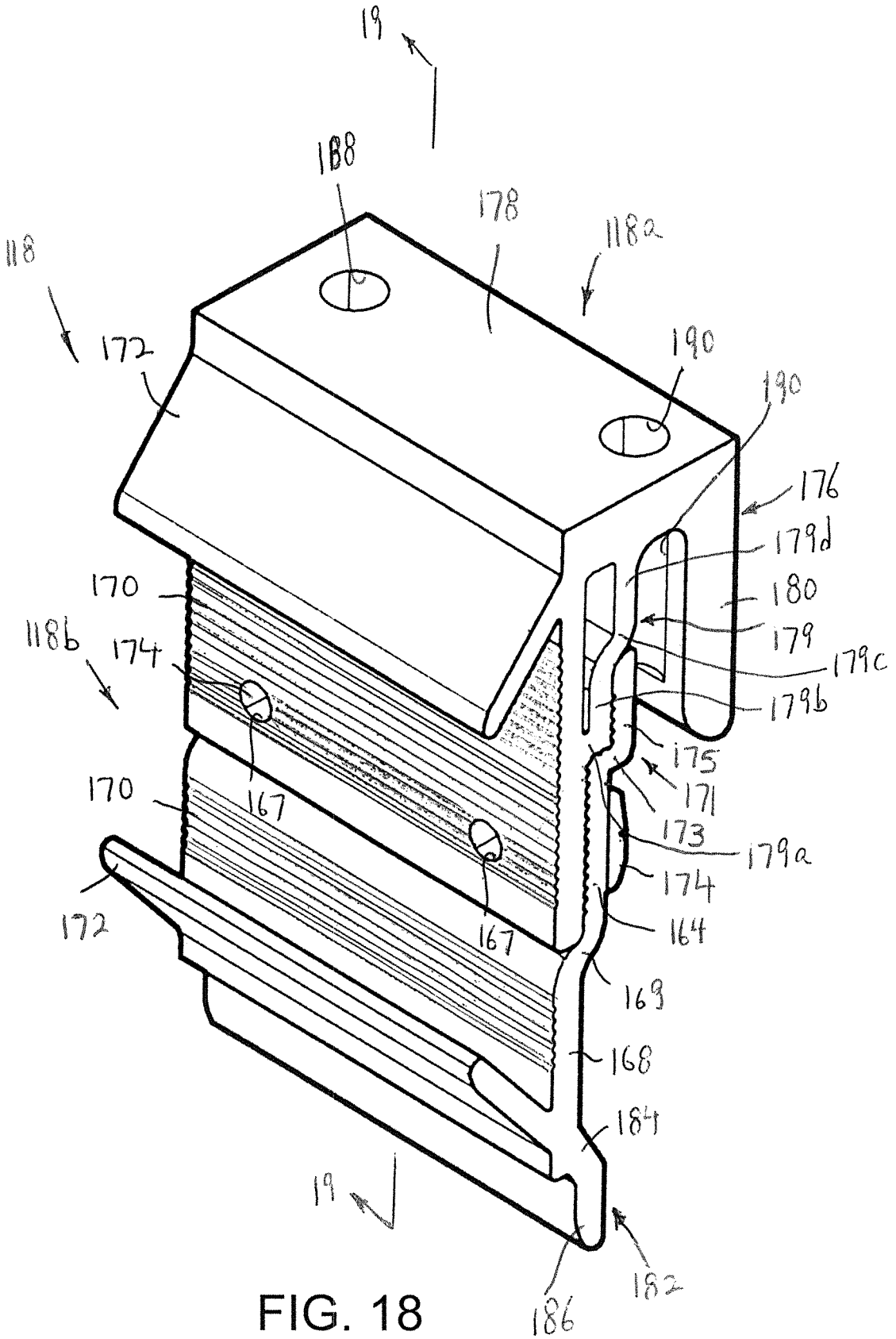
FIG. 18 is a perspective view of a modified mounting hanger for use with the elongated mounting track.
Figure 19:
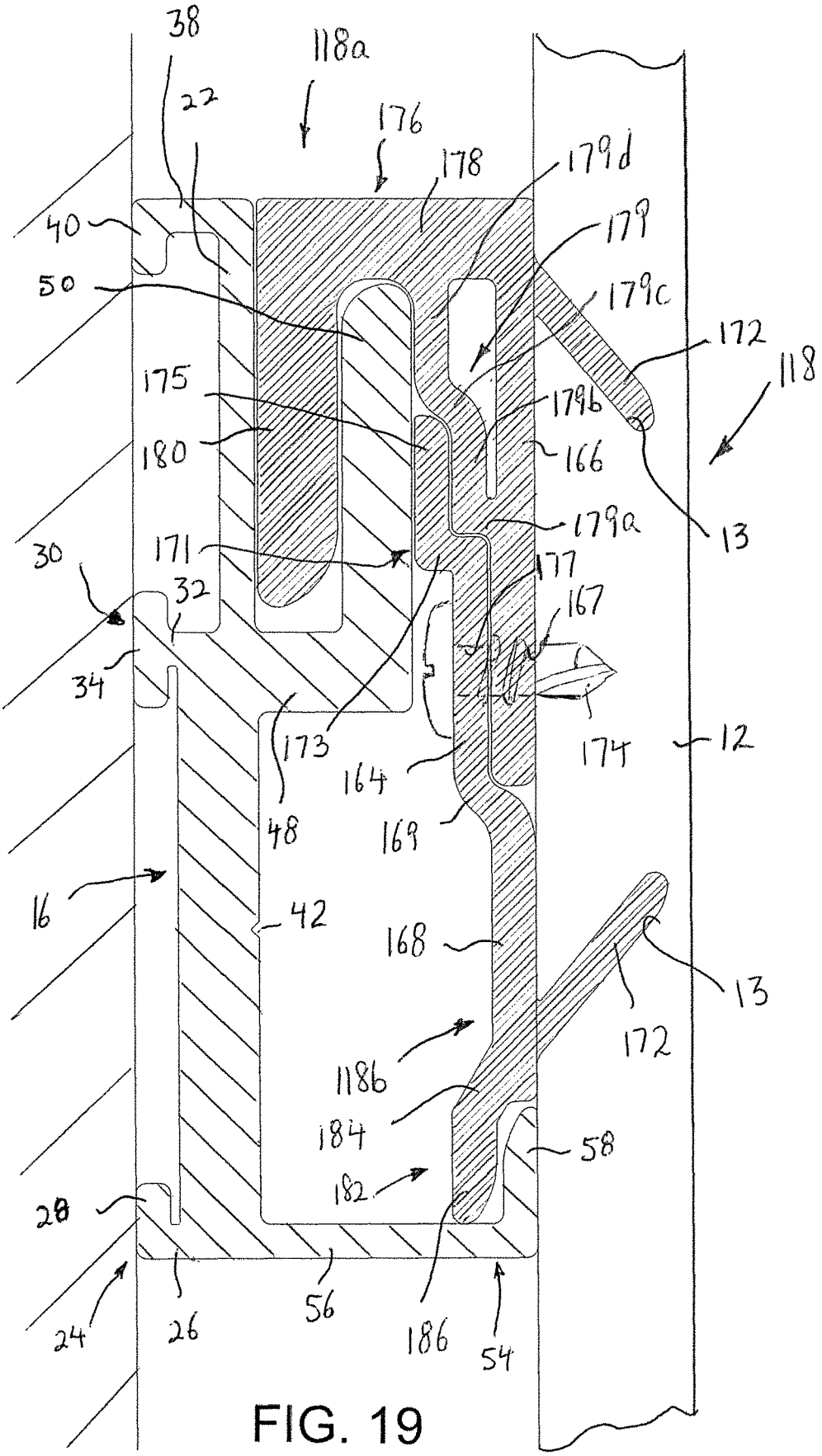
FIG. 19 is a cross-sectional view of the mounting hanger of FIG. 18, taken along line 19-19 thereof and assembled with the elongated mounting track.

Referring now to FIGS. 18 and 19, there is shown a modified mounting hanger 118 in which parts identical to those of mounting hanger 18 are referenced by the same reference numerals augmented by 100.

Mounting hanger 118 includes an upper mounting hanger part 118*a* and a lower mounting hanger part 118*b*.

Upper mounting hanger part 118*a* includes a vertically extending upper wall section 166 with an L-shaped hanger mounting wall 176 for hanging, and thereby securing, the mounting hanger 118 to an elongated mounting track 16. Specifically, hanger mounting wall 176 includes a first wall 178 extending rearwardly at a right angle from the rear surface at the upper end of upper wall section 166 and a second wall 180 extending downwardly from the free end of first wall 178 in parallel, spaced relation to upper wall section 166. In this manner, second wall 180 extends into channel 52 of elongated mounting track 16 while the lower surface of first wall 178 rests on the upper free end of second wall 50 elongated mounting track 16.

A reinforcing wall 179 is secured between a mid-position of upper wall section 166 and a mid-position at the lower surface of first wall 178. Specifically, reinforcing wall 179 includes a first short wall 179*a* extending at a right angle from the mid-position of the rear surface of upper wall section 166, a second wall 179*b* extending upwardly from the free and of first short wall 179*a*, a third wall 179*c* extending rearwardly and upwardly at about a 45° angle from the upper end of second wall 179, and a fourth wall 179*d* extending vertically up from the free end of third wall 179*c* in parallel, offset relation to second wall 179*b* and the upper end of which is connected with the lower surface of first wall 178.

Two horizontally spaced openings 167 are provided in vertically extending upper wall section 166 at a position below first short wall 179*a* of reinforcing wall 179.

A wall panel securing plate 172 extends downwardly at an angle of about 45° from the front surface of vertically extending upper wall section 166, for insertion in a similarly angled slot-like opening 13 in the rear surface of wall panel 12.

Lower mounting hanger part 118*b* includes a vertically extending lower wall section 168 which is connected by a rearwardly angled wall 169 at its upper end to a vertically extending mid wall section 164, which is parallel to lower wall section 168 but rearwardly offset thereto. An L-shaped wall 171 extends rearwardly and upwardly from the upper end of mid wall section 164. Specifically, L-shaped wall 171 includes a first wall 173 that extends rearwardly from the upper end of mid wall section 164 and a second wall 175 that extends upwardly from the free end of first wall 173.

A lower retaining wall 182 extends rearwardly and downwardly from the lower end of lower wall section 168. Specifically, lower retaining wall 182 includes a first wall 184 angled rearwardly and downwardly about 45° from the lower end of lower wall section 168 and a second wall 186 extending vertically down from the lower end of first angled wall 184 in parallel but offset relation to lower wall section 168. The lower end of second wall 186 sits behind second wall 58 and on first wall 56 to provide a second level of securement of mounting hanger 118 to elongated mounting track 16.

Two horizontally spaced openings 177 are provided in vertically extending mid wall section 164.

Another wall panel securing plate 172 extends upwardly at an angle of about 45° from the front surface of vertically extending lower wall section 168, for insertion in another slot-like opening 13 in the rear surface of wall panel 12. It will be appreciated that the two wall panel securing plates 172 are oppositely inclined.

Also, preferably, the front facing surfaces of vertically extending upper wall section 166 and vertically extending lower wall section 168 are provided with serrations or teeth 170 for better engagement with the rear surface of wall panel 12.

As with the first embodiment, mounting hanger 118 also provides for vertical adjustment and fixed securement on a respective elongated mounting track 16. Specifically, two offset openings 188 and 190 are provided in L-shaped hanger mounting wall 176 in the same manner as discussed in the first embodiment, and a detailed description is thereby omitted.

During assembly, upper mounting hanger part 118*a* and lower mounting hanger part 118*b* can be separately assembled with wall panel 12 via wall panel securing walls 172 and slot-like openings 13, and then screws 174 are fastened to wall panel 12 through openings 167 and 177, to further secure upper mounting hanger part 118*a* and lower mounting hanger part 118*b* to wall panel 12, and to each other.

Alternatively, upper mounting hanger part 118*a* and lower mounting hanger part 118*b* can first be secured together with screws 174 that terminate at the rear surface of vertically extending upper wall section 166 so as not to extend out therefrom. Then, both wall panel securing walls 172 are inserted in the two slot-like openings 13 simultaneously.

Figure 20:
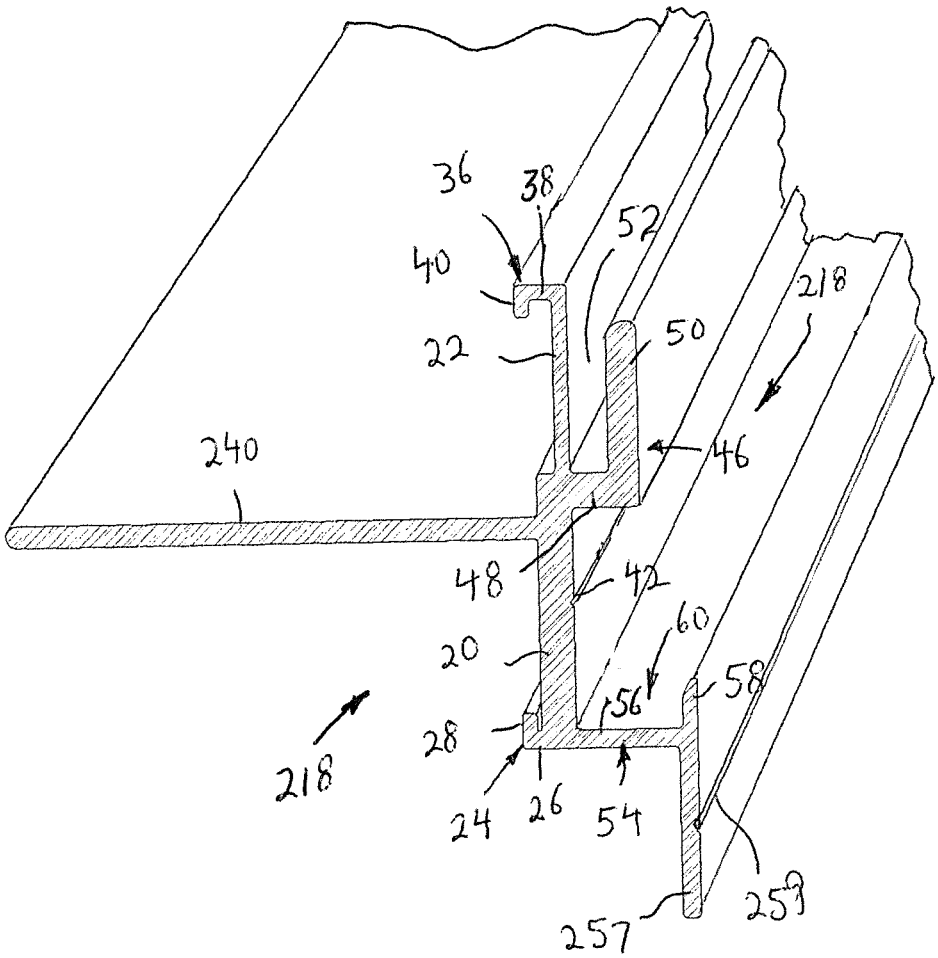
FIG. 20 is a perspective view, partly in section, of a modified elongated mounting track.

Referring now to FIG. 20, there is shown a cross-section of an elongated mounting track 218 according to another embodiment of the present invention. Specifically, elongated mounting track to 18 is intended to be used with the arrangement of applicant's U.S. Pat. Nos. 10,253,507 and 10,260,240, the entire disclosures of which are incorporated herein by reference.

Elongated mounting track 218 is identical to elongated mounting track 18, except as follows. In such case, the identical reference numerals used to designate the parts in elongated mounting track and are used for the same parts of the elongated mounting track 218, except where they differ.

Specifically, second spacer wall 30 is eliminated entirely. In place thereof, a horizontally extending adjustment support member 240 in the form of an elongated rectangular plate extends rearwardly at a right angle from the rear surface of first horizontally extending wall 20. Adjustment support member 240 is horizontally oriented. In this manner, adjustment support member 240 is intended to fit snugly between the capture walls of the sliding support member described in U.S. Pat. Nos. 10,253,507 and 10,260,240, and secured thereat by screws (not shown) extending through the capture walls and adjustment support member 240. With this arrangement, and the entire arrangement of U.S. Pat. Nos. 10,253,507 and 10,260,240, that is, with the adjustment of the sliding support members in the base of said patents, elongated mounting track 218 can be adjusted with respect to existing wall 14 with three degrees of freedom.

In addition, hanger stabilizing wall 54 includes a third wall 257 which is a continuation of second wall 58 and extends downwardly therefrom in coplanar relation, below first wall 54. When assembled with a wall panel 12, both second wall 58 and third wall 257 are in flush engagement with the rear surface of wall panel 12. In this regard, the front surface of third wall 257 has a shallow V-shaped notch 259 extending horizontally therealong at an approximate mid-height thereof. This makes it easy to secure screws (not shown) through third wall 257 into wall panel 12 in a final fixed position.

It will be appreciated that elongated mounting track 218 is movable in a horizontal direction. However, adjustment support member 240 can be oriented 90 degrees from that shown in FIG. 20, such that the mounting track 218 would be movable in a vertical direction.

Although the parts have been sectioned for metal, the parts can be made of any material, including but no limited to aluminum, plastic, composites or combinations of these materials.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A system for mounting wall panels to an existing wall, comprising: a plurality of elongated mounting tracks, each mounting track including: a base wall adapted to be secured to the existing wall, a hanger supporting wall extending forwardly from said base wall, and a hanger stabilizing wall extending forwardly from said base wall in spaced relation from the hanger supporting wall; a plurality of mounting hangers, each mounting hanger including: a wall panel securing wall adapted to be secured to a wall panel, a hanger mounting wall extending rearwardly from said wall panel securing wall and adapted to be hung on the hanger supporting wall, and a hanger retaining wall extending from said wall panel securing wall and adapted to engage with said hanger stabilizing wall; wherein said wall panel securing wall includes an arrangement for securing each said mounting hanger to a respective said wall panel; wherein said arrangement includes: two angled slot openings in a rear surface of each said wall panel, each slot opening extending at an angle different from the angle of the other slot opening, and two wall panel securing plates extending forwardly from said wall panel securing wall at different angles from each other for insertion in the two angled slot openings from a side edge of each said wall panel; wherein each mounting hanger includes: a first mounting hanger part which includes a first part of said wall panel securing wall, said hanger mounting wall and part of said arrangement, and a second mounting hanger part which includes a second part of said wall panel securing wall, said hanger retaining wall and part of said arrangement, wherein said first mounting hanger part and said second mounting hanger part are adapted to be assembled separately and independently with a respective said wall panel, and thereafter secured together; and wherein the first mounting hanger part includes one of said wall panel securing plates and the second mounting hanger part includes the other one of said wall panel securing plates.

2. A system for mounting wall panels to an existing wall according to claim 1, wherein said hanger supporting wall includes an upwardly opening L-shaped wall extending forwardly from said base wall, and said hanger mounting wall includes a downwardly opening L-shaped wall extending rearwardly from said wall panel securing wall, for engaging with said hanger supporting wall.

3. A system for mounting wall panels to an existing wall according to claim 1, wherein said hanger stabilizing wall includes an upwardly opening L-shaped wall extending forwardly from said base wall, and said hanger retaining wall extends rearwardly and downwardly from said wall panel securing wall, for engaging with said hanger stabilizing wall.

4. A system for mounting wall panels to an existing wall according to claim 1, wherein said hanger stabilizing wall extends forwardly from said base wall to a greater extent than said hanger supporting wall.

5. A system for mounting wall panels to an existing wall according to claim 1, wherein said hanger mounting wall includes a threaded adjustment opening for receiving a set screw for engagement with said hanger supporting wall to adjust the height of each mounting hanger relative to each respective elongated mounting track.

6. A system for mounting wall panels to an existing wall according to claim 1, wherein said hanger mounting wall includes a threaded fixing opening for receiving a screw to fix said hanger mounting wall to said hanger supporting wall.

7. A system for mounting wall panels to an existing wall according to claim 6, wherein the screw in the threaded fixing opening fixes said hanger mounting wall to said hanger supporting wall with a wedging action.

8. A system for mounting wall panels to an existing wall according to claim 1, wherein each of said first and second parts of said wall panel securing wall includes an opening aligned with the other of said first and second parts of said wall panel securing wall when said first and second mounting hanger parts are assembled with said wall panel, for receiving a screw therethrough and into said wall panel so as to secure said first and second mounting hanger parts together and to said wall panel.

9. A system for mounting wall panels to an existing wall according to claim 1, wherein said base wall includes an adjustment support member extending rearwardly therefrom for engagement with a support assembly secured to the existing wall, for movement relative thereto with at least one degree of freedom.

* * * * *